United States Patent [19]

Perry et al.

[11] 4,348,281

[45] Sep. 7, 1982

[54] SKIMMER ASSEMBLY FOR SWIMMING POOLS

[75] Inventors: Stephen J. Perry, Arcadia; Gordon F. Ehret, Alhambra; William N. Rowley, Palos Verdes Estates, all of Calif.

[73] Assignee: Marley/Wylain Company, Mission, Kans.

[21] Appl. No.: 230,517

[22] Filed: Feb. 2, 1981

[51] Int. Cl.[3] ..... E04H 3/20

[52] U.S. Cl. ..... 210/129; 210/163; 210/169; 210/119; 4/490

[58] Field of Search ..... 210/169, 163, 184, 129, 210/121, 123, 119, 490

[56] References Cited

U.S. PATENT DOCUMENTS

| | | | |
|---|---|---|---|
| 3,067,879 | 12/1962 | Baker | 210/169 |
| 3,306,448 | 2/1967 | Baker | 210/169 |
| 3,316,934 | 5/1967 | Sowers | 210/169 |
| 3,443,264 | 5/1969 | Miller | 210/169 |
| 3,481,470 | 12/1969 | Valois | 210/169 |
| 3,508,661 | 4/1970 | Diemond et al. | 210/169 |
| 3,567,020 | 3/1971 | Whitaker | 210/169 |
| 3,620,372 | 1/1971 | Ehret | 210/169 |
| 3,701,427 | 10/1972 | Howard | 210/169 |
| 3,706,379 | 12/1972 | Erlich | 210/169 |
| 3,716,873 | 2/1973 | Blum | 210/169 |
| 3,724,666 | 4/1973 | Johnson | 210/169 |
| 3,749,424 | 7/1973 | Greene | 210/169 |
| 3,841,487 | 10/1974 | Villette | 210/169 |
| 3,910,840 | 10/1975 | Adam | 210/169 |
| 4,007,566 | 2/1977 | Molitor | 210/169 |
| 4,038,789 | 8/1977 | Axgarde | 210/163 |
| 4,059,520 | 11/1977 | Poller | 210/184 |
| 4,126,925 | 11/1978 | Jacuzzi | 210/169 |
| 4,154,679 | 5/1979 | Large | 210/169 |

*Primary Examiner*—Benoît Castel

*Attorney, Agent, or Firm*—Schmidt, Johnson, Hovey & Williams

[57] ABSTRACT

A skimmer assembly for use in swimming pools in which a skimmer housing is provided with a skimming inlet and a drain inlet for receiving water from a pool. An outlet is also provided for connection with a vacuum source for discharging water from the housing. A floating weir is disposed in the housing for regulating the amount of water entering the housing from the skimming inlet and a filter basket is disposed in the housing with its open end communicating with the skimming inlet and a wall portion communicating with the drain inlet. An adaptor member and a cover plate cooperate with said basket for selectively controlling the flow of water from said skimming inlet to said outlet. The basket is adapted to attain a plurality of positions in the housing for regulating the flow through the drain inlet to the housing, and a sealing assembly is provided on the weir and the basket for sealing off flow through the skimmer inlet when the level of water in the pool falls below a predetermined value. The weir is adapted to accommodate an adaptor assembly for attaching a vacuum hose to the assembly for vacuuming selected portions of the pool under the vacuum created by the aforementioned vacuum source. A valve relief mechanism is provided on said weir for permitting water flow from said skimming inlet in the event the drain inlet becomes blocked when the weir is in its sealing position.

5 Claims, 8 Drawing Figures

SKIMMER ASSEMBLY FOR SWIMMING POOLS

BACKGROUND OF THE INVENTION

This invention relates to a skimmer assembly for use in a swimming pool and, more particularly, to such an assembly for regulating the flow of water from the upper surface of the pool and the main pool drain to an externally located pump-filter assembly, for circulating and cleaning the water.

A conventional swimming pool installation usually incorporates a pump and filter located adjacent the pool for circulating and filtering the pool water. In these arrangements, one or more skimmers are usually provided which are adapted to skim off the upper surface of the pool water and pass same to the pump-filter assembly for filtering and recirculation. The amount of pool water skimmed is usually controlled by a floating weir associated with each skimmer which is responsive to the level of water in the pool to insure that only a predetermined amount of water from the upper surface of the swimming pool will be introduced into the skimmer.

Although these arrangements are operative through substantial variations in the height of water in the pool, there are limits to their range of operation since the level in the swimming pool may drop below the inlet opening to the skimmer so that the weir can no longer maintain flow from the pool by lowering. In such circumstances, the tank will run dry and the pump will draw air which, of course, not only incurs the possibility of damaging the pump, but creates a nuisance as far as restarting the system is concerned.

Several techniques have been devised to alleviate this problem, including the provision of connecting the drain from the pool to the skimmer tank so that the pump will draw water from the drain both during the time the weir is operating in its normal manner and when it reaches its lowermost position in response to the level of water in the pool falling below a predetermined value.

However, in these arrangements there is little, if any, provision for regulating the flow of water from the pool drain and, therefore, the proportional amount of water drawn from the upper surface of the pool and from the pool drain. Also, it is customary to provide an attachment or the like for enabling a vacuum hose to be connected to the skimmer in a manner such that the bottom of the pool can be "vacuumed" by utilizing the vacuum from the pump-filter assembly. However, when the skimmer tank is connected to the pool drain it can be appreciated that the flow from the drain must be blocked during the vacuuming process, so that the full vacuum load of the pump will be available. This requires fairly elaborate and extensive connections using additional hardware which places an added burden on the operator/owner of the swimming pool. Also, in the event these types of connections are not removed after the vacuuming is complete, or if the pool drain is blocked in any other manner, the tank will run dry and the pump will pump air under the circumstances set forth above.

SUMMARY OF THE INVENTION

It is therefore an object of the present invention to provide a swimming pool skimmer assembly which is easy to operate and which provides regulated flow from the pool drain through the skimmer tank.

It is a further object of the present invention to provide a skimming assembly of the above type in which the skimming inlet to the skimmer tank is automatically sealed by the floating weir upon the water level in the pool dropping below a predetermined value.

It is a still further object of the present invention to provide in a skimming assembly of the above type in which the floating weir can easily be adapted to accommodate an adaptor for a vacuum assembly.

It is a still further object of the present invention to provide a skimming assembly of the above type in which connection of the adaptor assembly to the weir automatically blocks the flow of water from the pool drain to the skimmer tank.

It is a still further object of the present invention to provide a skimming assembly of the above type in which a vacuum relief mechanism is provided which ensures that the skimmer tank will not run dry and the pump will not pump air even if the weir is in its sealing position and the drain inlet is blocked.

It is a still further object of the present invention to provide a skimming assembly of the above type in which the flow from the skimming inlet through the basket and to the outlet is selectively controlled.

Toward the fulfillment of these and other objects, the skimming assembly of the present invention comprises a housing having a skimming inlet for receiving water from the pool, a drain inlet for receiving water from the pool, and an outlet for communicating with a vacuum source for discharging water from the housing. A floating weir is disposed in the housing in the path of water entering the housing through the skimming inlet for maintaining a predetermined level of water in the housing. A filter basket is disposed in the housing between the drain inlet and the outlet with its open end communicating with the skimming inlet. The basket has three wall portions with different size openings extending therethrough which are adapted to selectively align with the drain inlet in a predetermined position of the basket relative to the housing to regulate the flow of water from the pool drain into the housing. A device can also be installed in the basket to allow selective control of water flow over the weir, thus providing a very wide range of weir flow versus main drain flow. The weir is adapted to accommodate an adaptor assembly for permitting the pool to be vacuumed and a valve relief mechanism is provided on the weir.

BRIEF DESCRIPTION OF THE DRAWINGS

The above brief description, as well as further objects, features and advantages of the present invention will be more fully appreciated by reference to the following detailed description of a presently preferred but nonetheless illustrative embodiment in accordance with the present invention, when taken in conjunction with the accompanying drawings wherein.

DESCRIPTION OF THE PREFERRED EMBODIMENT

Figure 1:
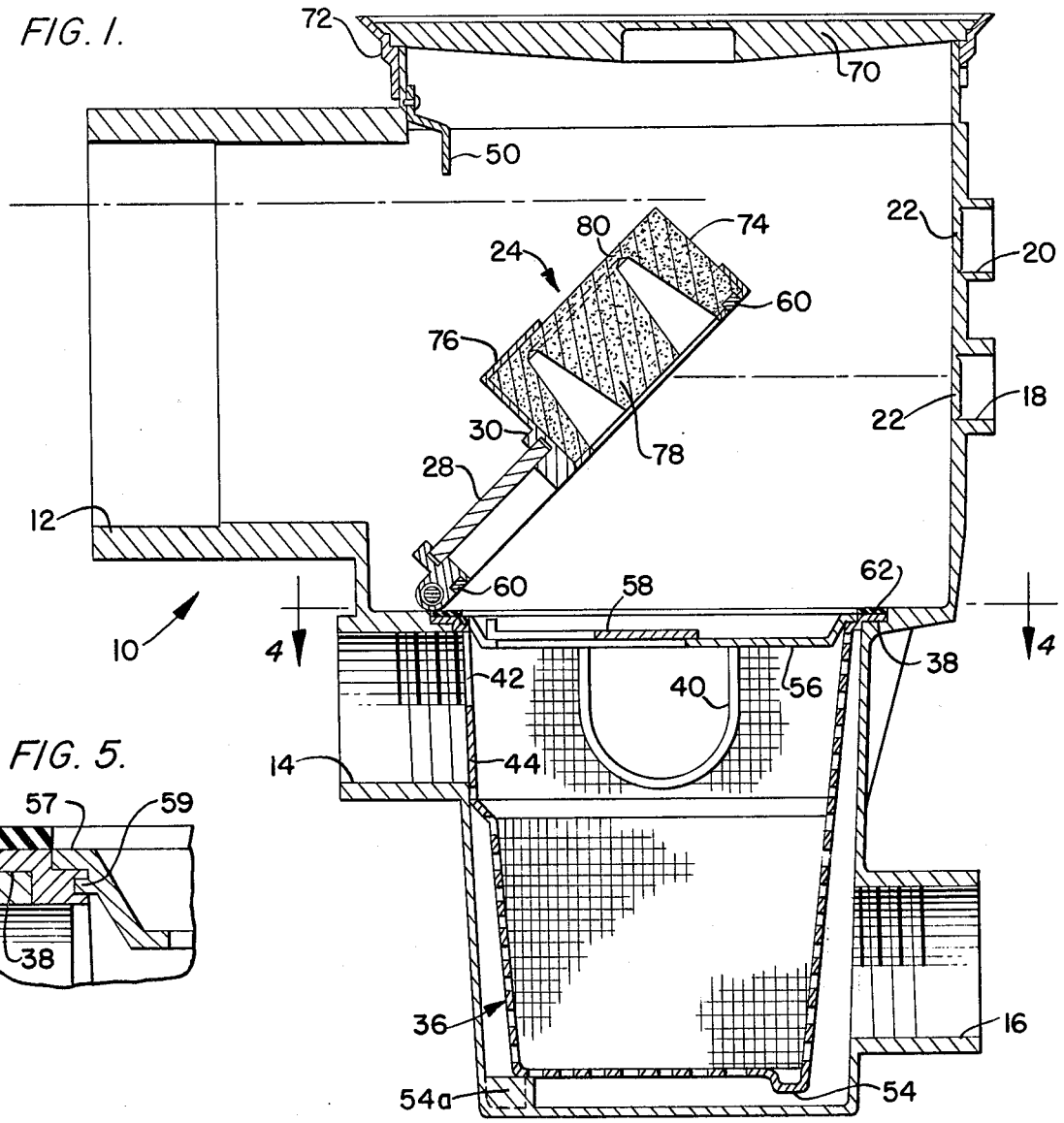
FIG. 1 is a vertical cross-sectional view of the skimmer assembly of the present invention.

Referring specifically to FIG. 1 of the drawings, the reference numeral 10 refers in general to a one-piece skimmer body, preferably of a plastic material, which includes a large mouth opening 12 to accommodate a wide-mouth adaptor (not shown) for introducing water from the pool directly into the body 10. The body 10 can alternatively be molded in one piece with a large mouth opening.

The body 10 is provided with an inlet 14 which is connected by suitable piping to a drain located in the floor of the swimming pool. A pump outlet 16 is provided which can be connected to a conventional pump-filter assembly, which is usually located adjacent the pool in an equipment house, or the like, and which operates to circulate the water through the pool for cleaning same. It is noted that both the pool drain inlet 14 and the pump outlet 16 consist of a straight and a welded portion to permit either solvent welding of the associated plastic pipe or engagement by a threaded pipe. An optional fill port 18 and overflow drain port 20 are located at an upper wall portion of the body 10 and are provided with knock-out plugs 22 in the event they are to be used.

Figure 2:
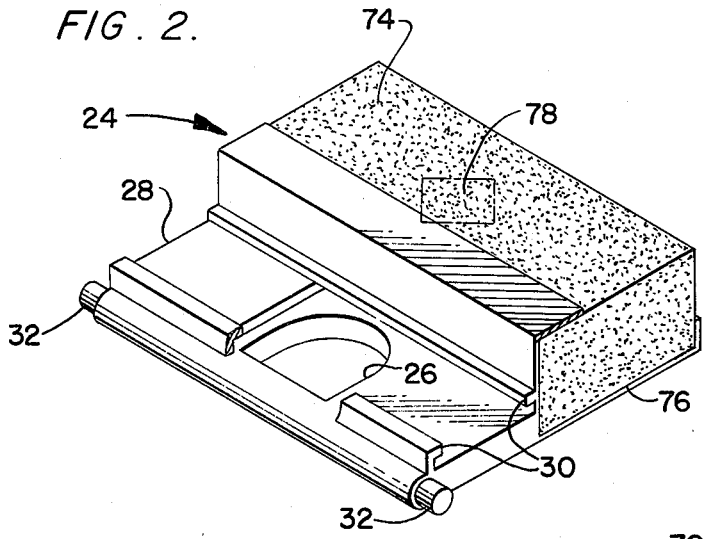
FIG. 2 is a perspective view of the floating weir utilized in the assembly of FIG. 1.

A weir 24 is pivotally mounted in the body 10 in communication with the mouth opening 12 for controlling the amount of water passing from the upper surface of the pool into the body. The weir 24 is better shown in FIG. 2 and includes a port 26 and a port cover 28 which is slidably mounted under a pair of ledges 30 between a position covering the port and the position shown whereby the port is exposed. A pair of spring-loaded rods 32 are provided at each end of a cylindrical bore provided at one end of the weir 24 and are adapted to engage within suitable openings (not shown) provided in the body 10 for pivotally mounting the weir relative to the body 10.

Figure 3:
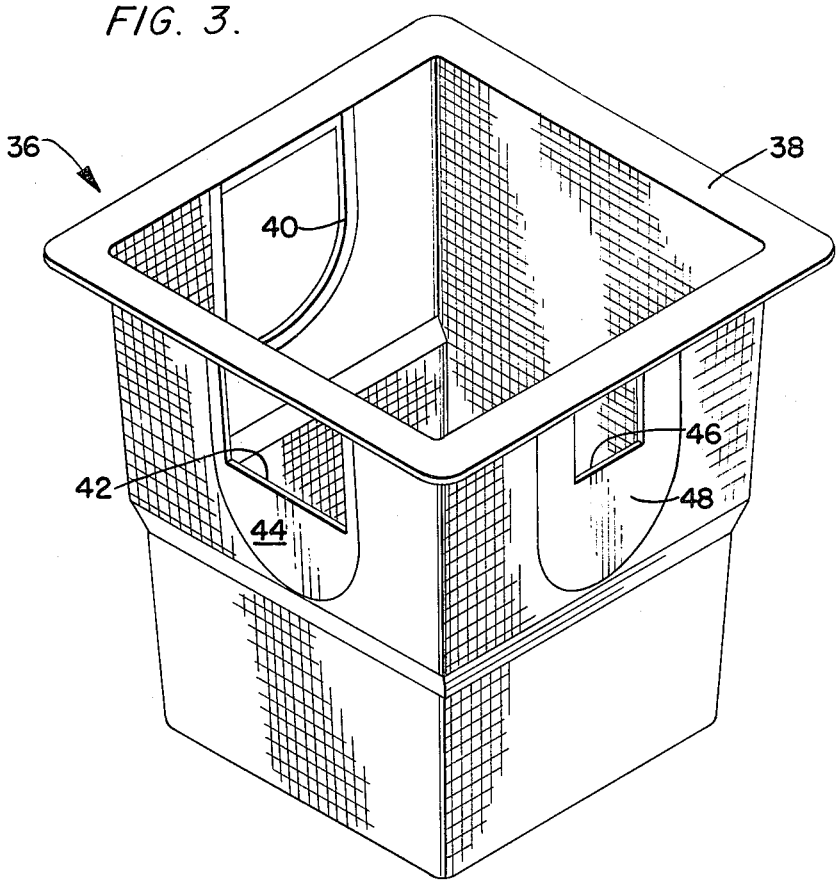
FIG. 3 is a perspective view of the filter basket utilized in the assembly of FIG. 1.

As better shown in FIGS. 1 and 3, a substantially perforated basket, shown in general by the reference numeral 36, is provided in the body 10 and includes a continuous, outwardly extending ledge 38 which rests on a correspondingly formed shoulder provided within the skimmer body. The basket 36 is substantially rectangular in shape and has four substantially upright perforated walls, one of which has a large opening 40 formed through its upper portion. An adjacent wall has an opening 42 formed through its upper portion which is approximately half the size of the opening 40. The latter wall also includes a solid, non-perforated, portion 44 extending around and immediately below the opening 42. A third wall, shown only in FIG. 3, which is opposite the wall containing the opening 40, has an opening 46 extending therethrough which is smaller than the openings 42 and a solid portion 48 extending immediately below the opening 46. The fourth wall, which is opposite the wall containing the opening 42, is constructed of the standard perforated material.

The arrangement and location of the openings 40, 42 and the solid portion 44 are such that the basket 36 can be placed in the portion shown in FIG. 1 with the opening 42 (and the solid position 44 extending immediately below the opening 42) in alignment with the drain inlet 14 to permit approximately half-flow from the inlet. Also, the basket 36 can be placed in the body 10 with the opening 40 in alignment with the drain inlet 14 to permit full flow from the inlet, and when the opening 46 is placed in alignment with the inlet 14, approximately one-quarter flow is permitted.

A catch assembly 50 is provided in the upper portion of the body member 10 for retaining the weir 24 in a vertical position to permit the basket 36 to be moved to one of the three positions discussed above.

A mislocation stop 54 (FIG. 1) is provided on the lower portion of the basket 36 and extends below the above-mentioned fourth, perforated, wall, while an upwardly extending boss **54*a* is formed on the floor of the housing 10 below the drain inlet. The stop 54 and the boss 54*a* cooperate to prevent the basket from being inserted in the housing 10 with the flange 38 properly seated on the corresponding shoulder when the perforated wall of the basket extends over the drain inlet 14**.

Figure 5:
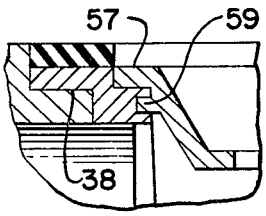
FIG. 5 is an enlarged, partial view of a portion of FIG. 1.
Figure 4:
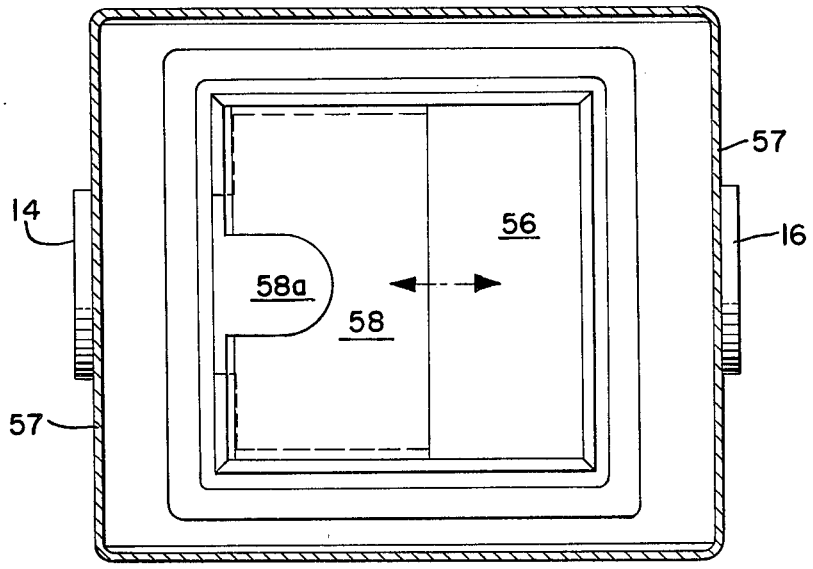
FIG. 4 is a cross-sectional view taken along the line 4—4 of FIG. 1.

Referring to FIGS. 1, 4 and 5, an adaptor 56 may be provided which extends across the open end of the basket 36 and has an outwardly extending flange 57 that fits onto a corresponding shoulder formed on the basket. A relatively large opening extends through the adaptor 56 and a pair of ledges are provided on the adaptor that receive a plate 58 which slides relative to the adaptor to vary the effective size of the opening. Thus, slidable movement of the plate 58 relative to the adaptor 56 controls the flow of water passing into the basket 36 and therefore over the weir 24 and thus provides a very wide range of weir flow versus main drain flow.

A hole **58*a* is provided through the plate 58 so as to allow vacuuming through the weir 24 and the plate when the basket 36 is in the vacuum position, as will be described later, and a pair of alignment tabs 59 are provided to lock the adaptor 56 into place on the basket 36**, and to insure that the adaptor can only be installed onto the basket in the position shown to permit vacuuming.

Figure 6:
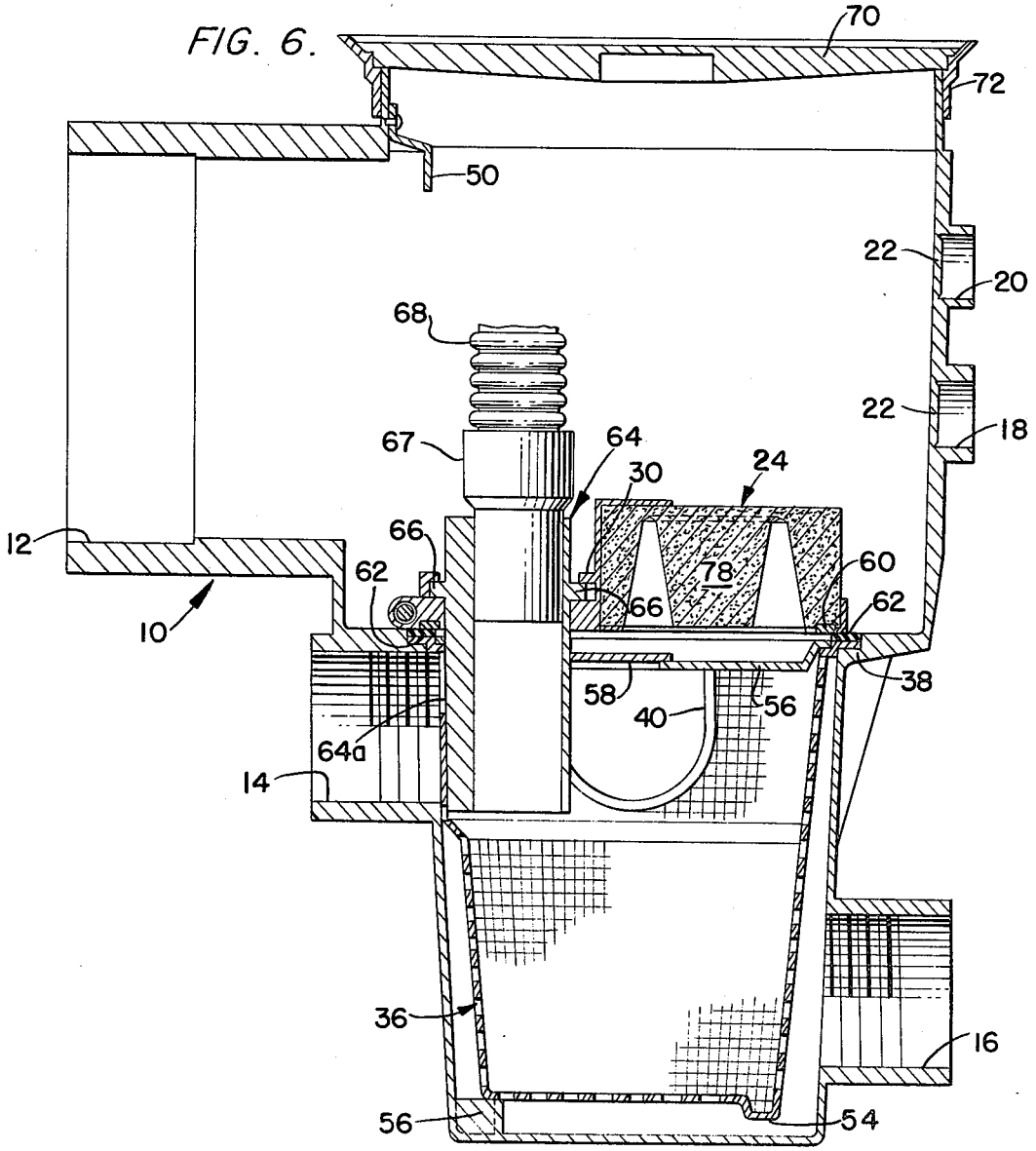
FIG. 6 is a view similar to FIG. 1 but showing the skimmer assembly in a different operational mode.

The weir 24 is designed to float in the body 10 in the manner shown in FIG. 1 to allow a predetermined amount (for example, one-eighth of an inch) of the upper surface of the swimming pool water to enter the body through the opening 12. The weir 24 will respond to variations in the height of the pool water over a limited range and control the skimming action, but when the level of the pool water drops below a predetermined value, the weir will take a substantially horizontal position in the body 10, as shown in FIG. 6. A rectangular gasket 60 is provided on the lower surface of the weir 24 which engages with an additional correspondingly sized gasket 62 disposed on the upper surface of the flange 38 of the basket 36 when the weir is in its horizontal position. The gaskets 60 and 62 cooperate to effectively seal the mouth opening 12 from the interior of the basket 36 and thus preventing any flow of water from the pool through the body 10 and into the pump outlet 16. In this position, the pump would draw water from the drain inlet 14 with the amount depending on which one of the openings 40, 42 or 46 in the basket 36 is positioned in alignment with the inlet.

The port 26 provided in the weir 24 is adapted to accommodate a vacuum port adaptor shown in general by the reference numeral 64 in FIG. 6, which extends through the port and the opening **58*a*** in the cover plate 58 and has a continuous outwardly-extending flange 66 that extends between the ledges 30 and seats on the weir 24. The adaptor 64 is shaped in cross-section to conform with the shape of the port 26 (FIG. 2) and thus includes a flat wall portion 64*a* which, in the operative position of the adaptor shown in FIG. 6, fits snugly against the basket 36 to block the flow of fluid from the pool drain inlet 14 irrespective of the position of the basket 36 in the body 10.

The adaptor 64 is adapted to receive the cuff 67 of a standard vacuum cleaning hose 68 which, in turn, can extend to a location remote from the location of the skimmer body 10 and is adapted to receive a wand, or other suitable attachment (not shown), so that the pool floor can be "vacuumed" under the vacuum provided by the pump connected to the pump outlet 16 to remove debris from the pool floor. Thus, this vacuuming can easily be accomplished by simply pushing the weir 24 to its closed horizontal position, sliding the port cover 28 over to expose the port 26 and inserting the vacuum port adaptor 64 and the hose 68 with the pump running. Since the main pool drain inlet 14 is blocked by the adaptor 64 the entire vacuum from the pump outlet 16 is directed to the vacuum hose 68.

As shown in FIGS. 1 and 6, a lid 70 is provided over the top open end portion of the body 10 and is connected to an adjustable collar 72 which, in turn, is adjustably mounted relative to the body 10 by a bolt assembly (not shown) to permit vertical height adjustment of the lid. Additional collars may be stacked to provide even greater adjustment range.

Figure 7:
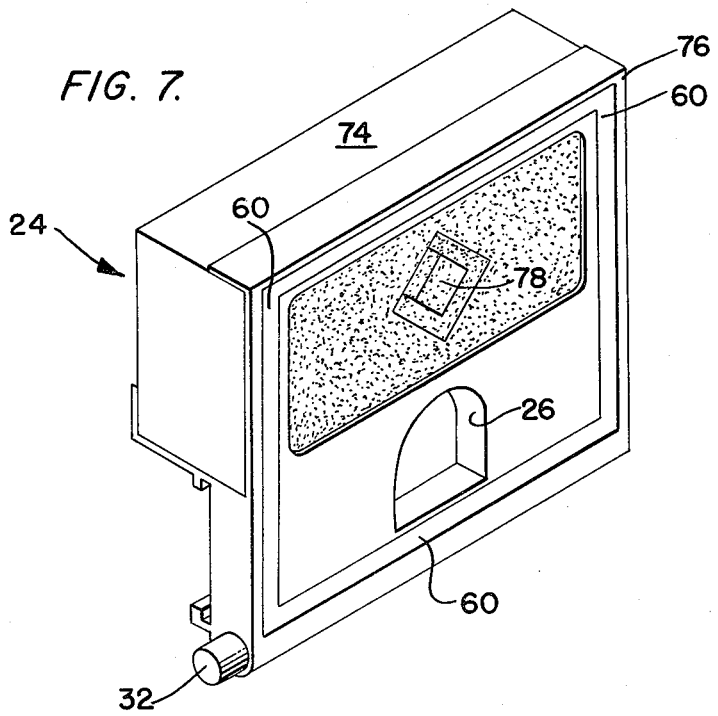
FIG. 7 is a rear elevational view of the floating weir of FIG. 2.

The weir 24 is provided with a vacuum relief mechanism to insure that the pump will draw water even if the weir is in the closed position of FIG. 6 and the pool drain or pool drain inlet 14 is blocked either on purpose or by accident. To this end, and referring to FIGS. 2 and 7, the main portion of the body of the weir 24 is formed by a block-like member 74 formed of a polyfoam material, which is supported within a casing 76. A knock-out plug 78 is formed within the member 74 which is not enclosed by the casing 76 and which is connected to the remaining portion of the member 74 by a relatively thin section 80 (FIG. 1) which is adapted to break under a predetermined force. Thus, with the weir 24 in its closed position of FIG. 6, and with the adaptor 64 removed (and the cover 28 extending over the port 26), in the event that the pool drain or the drain inlet 14 becomes blocked, the vacuum from the pump would exert a force on the plug 78 sufficient to break its connection with the remaining portion of the member 74, causing the plug to separate and form an opening through the member 74 which exposes the pump outlet 16 to the water from the pool through the opening 12. This, of course, prevents the skimmer tank from running dry and prevents the pump from drawing air.

It is thus seen that the present invention provides a simple and effective method of adjusting the flow from the pool drain through the skimmer body. Also, an effective seal is provided when the floating weir attains its horizontal position in the body member in response to the level of the pool water extending below a predetermined value. Further, a quick and easily-attached vacuum adaptor is provided for the weir which not only provides an easy method of attaching a vacuum hose and associated apparatus but also blocks off the pool drain inlet. Also, a valve relief mechanism is provided which insures a flow of water to the outlet 16 even if the weir is in its horizontal, sealing position and the drain inlet 14 is blocked.

Figure 8:
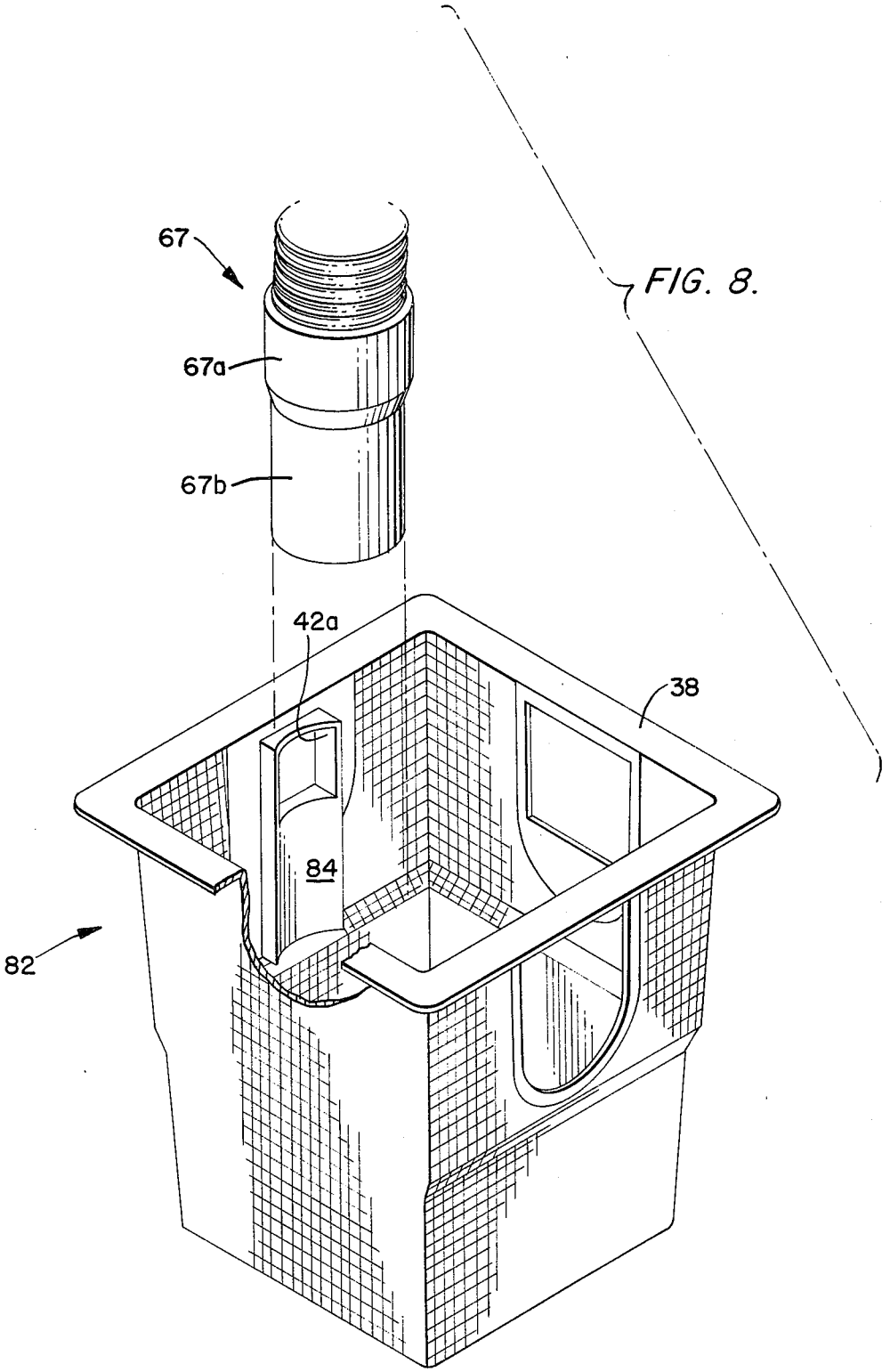
FIG. 8 is a view similar to FIG. 3, but depicting an alternate embodiment of the basket used in the assembly of FIG. 1.

It is understood that several variations may be made in the foregoing without departing from the scope of the invention. For example, the adaptor 64 for the hose cuff 67 can be eliminated and the basket can be constructed to directly receive the cuff. This embodiment is shown in FIG. 8 and features a basket 82 which has a concave mounting block 84 molded to an inside wall surface with the curvature of the block conforming to that of the cuff 67. As a result, when it is desired to vacuum the pool, the cuff is inserted through the port 26 of the weir 24 (which port could have a circular cross-section) and against the block 84. The basket 82 could be otherwise constructed in a manner identical to the basket 36 of the previous embodiment with the mounting block 84 extending just below the smallest opening, referred to by the reference numeral 42*a* in FIG. 8, formed in a wall of the basket.

The cuff 67 has an upper portion 67*a* which has a diameter larger than that of the lower portion 67*b*, so that when the cuff is inserted through the port 26 and into the basket 82, the lower cuff portion 67*b* engages the mounting block 84 and the upper cuff portion 67*a* extends over the opening 42*a* to block flow through this opening. Thus, the pool drain inlet would be blocked by the cuff and the entire vacuum from the pump outlet would be directed to the cuff 67 and therefore to the vacuum hose 68, as in the previous embodiment.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A skimmer assembly for use in swimming pools comprising:

a housing having walls presenting a cavity and further including—structure defining a skimming inlet in communication with said cavity for receiving water from the water line of said pool, structure defining a second inlet in communication with said cavity for receiving water from a level below the water line of said pool, and structure defining an outlet in communication with said cavity for communicating said cavity with a vacuum source for discharging water from said housing; a filter basket disposed in said housing including a generally upright, perforate sidewall structure defining a basket opening; and means for controlling the ratio of the flow of water entering said cavity through said skimming inlet to the flow of water entering said cavity through said second inlet including—a buoyant weir disposed in said housing between said skimming inlet and said outlet and shiftable between an open and closed position for regulating the amount of water entering said housing through said skimming inlet, separate means operatively attached to said basket sidewall presenting respective, spaced apart, flow restricting orifices of different effective flow control dimensions, each orifice being selectively positionable in a location relative to said second inlet for selective control of the volume of water permitted to flow from below the water line of the pool through said second inlet to the outlet via said orifice, means mounting said basket within said housing generally between said skimming inlet and said outlet for selective shifting of said basket to a position where one of said orifices is adjacent said second inlet to restrict flow of water from said second inlet to the cavity in accordance with the size of said orifice, a top wall secured to said basket sidewall structure configured to substantially cover said opening, said top wall defining a water flow aperture therethrough and including a shiftable cover for selectively adjusting the size of the aperture.

2. A skimmer assembly as in claim 1, said mounting means including means for aligning said basket in a position wherein one of said orifices is adjacent said second inlet, said aligning means including an outwardly extending projection on said basket and an inwardly projecting boss on said housing, said projection and said boss cooperatively engageable to prevent improper seating of said basket within said housing when said basket is inserted in said housing such that none of said orifices are aligned with said second inlet.

3. A skimmer assembly as in claim 1, said weir including structure defining an aperture therethrough with means for sealingly receiving a hose, and means for selectively covering said aperture.

4. A skimmer assembly as in claim 3, said orifice presenting means including means for sealingly receiving said hose for essentially blocking all water flow into said cavity through said second inlet.

5. A skimmer assembly as in claim 1, said weir including a flow-blocking member for preventing the flow of water from said inlet to said outlet when said weir is in said closed position, said member including means for relieving the vacuum created within said cavity by said vacuum source when said weir is in said closed position.

* * * * *